US005401215A

United States Patent [19]

Pfost

[11] Patent Number: 5,401,215

[45] Date of Patent: Mar. 28, 1995

[54] BILLIARD BALL AIMING SYSTEM

[76] Inventor: R. Fred Pfost, 1090 Eastwood Ct., Los Altos, Calif. 94022

[21] Appl. No.: 116,007

[22] Filed: Sep. 2, 1993

[51] Int. Cl.[6] ..... A63B 37/00

[52] U.S. Cl. ..... 473/2

[58] Field of Search ..... 473/2; 273/58 R, 63 C, 273/52, DIG. 24

[56] References Cited

U.S. PATENT DOCUMENTS

| | | | |
|---|---|---|---|
| 3,411,779 | 11/1968 | McGowan | 473/2 |
| 3,630,601 | 12/1971 | Lebovee | 273/DIG. 24 |
| 3,711,091 | 1/1973 | Dixon | 273/2 |
| 3,917,264 | 11/1975 | Davidson et al. | 273/DIG. 24 |
| 3,971,560 | 7/1976 | Panosh | 273/DIG. 24 |
| 3,993,305 | 11/1976 | Nicholson | 473/2 |
| 4,120,494 | 10/1978 | Rol | 473/2 |
| 4,688,796 | 8/1987 | Wright | 273/68 |

*Primary Examiner*—Theatrice Brown
*Attorney, Agent, or Firm*—Schneck & McHugh

[57] ABSTRACT

A method and apparatus for aiming billiard balls comprising an object ball with a surface coated with an array of colored dots. Adjacent dots are dissimilarly colored to aid in their distinguishment. A desired trajectory is aimed for by first sighting the object ball from a direction opposite a target and selecting a contact dot disposed collinear with that trajectory and furthest from that target. A cue ball or other striking means is then aimed to strike the object ball at the contact dot.

7 Claims, 2 Drawing Sheets

BILLIARD BALL AIMING SYSTEM

TECHNICAL FIELD

The present invention relates to a method and apparatus for aiming rigid bodies, such as billiard balls, to collide and travel along desired trajectories.

BACKGROUND ART

In games such as billiards and shuffleboard, a rigid body is propelled to collide with another rigid body, in order to direct one or both of the bodies to desired locations. In pocket billiards, for example, a cue ball is struck by a cue stick and propelled toward an object ball. The collision between the cue ball and the stationary object ball is designed to cause the object ball to travel in a desired trajectory, such as that leading to a billiard table pocket. At the same time, the collision between the two balls typically must be designed so that the cue ball does not travel into any of the billiard table pockets.

While it may seem easy in principle to aim a cue ball to collide with an object ball at the correct location to cause desired post-collision trajectories of cue and object balls, in practice it is not always easy. One problem is that errors in the direction the cue ball travels to strike the object ball relative to the direction aimed are not easily distinguishable from errors in aiming the cue ball. That is, the person playing pool may not know whether he or she missed a shot due to aiming incorrectly or due to aiming correctly but addressing the cue ball incorrectly with the cue stick. Similarly, aiming incorrectly may, in combination with striking the cue ball erroneously with the cue stick, result in a successful shot. This confusion thwarts the progress of players and prolongs the period required for training.

Several patents have addressed the issue of aiming objects such as billiard balls. U.S. Pat. No. 3,993,305 to Nicholson discloses a billiard ball that is patterned to help train billiard players to aim using a system known as "sighting by object ball displacement." In this method, a training ball is provided that has stripes extending between two opposed poles. The ball is positioned on the table as an object ball and has its poles vertically aligned and its stripes aligned with the desired trajectory. That is, it is manually rotated to where one pole is in contact with the table and the other pole is at the top of the ball, and a stripe is aligned to be on the opposite side of the ball from the desired trajectory of the object ball. Next, it is determined whether the desired shot is a "thin-ball", "quarter-ball", "half-ball" or "full-ball". Then the training ball is sighted from behind the cue ball so that the cue ball obstructs from view a fraction of the training ball corresponding to the type of shot it has been determined to be. For example, for a "quarter-ball "shot, one quarter of the training ball is obstructed from view by the cue ball. The cue ball is then aimed in a direction parallel to that between an edge of the cue ball and the desired visually obstructed fraction of the training ball.

Similarly, U.S. Pat. No. 3,711,091 to Dixon describes a pointing apparatus which may be placed on the pool table playing surface or the railing surrounding the playing surface and which indicates the desired trajectory of the object ball. The apparatus generally includes a pair of imitation pool balls attached to each other and to a pointer shaft and mounted on a foundation. A more modern approach to aiming in billiards is disclosed in U.S. Pat. No. 4,68.8,796 to Wright, which describes a cue stick having a collimated beam of light that can be activated to project from its tip. The beam of light can be used to help aim the cue stick at the cue ball, the cue ball at the object ball and, when augmented by reflective strips attached to the table railing, the cue or object ball at targets to be struck by banking the balls off of the railing.

In a somewhat similar vein, U.S. Pat. No. 3,917,264 to Davidson et al. describes a billiard table area that is illuminated with a source of invisible, ultraviolet light, and pool balls and playing devices that are coated with a material that emits visible light when exposed to such ultraviolet light, thereby providing the illusion that the balls are floating on an invisible plane. The ultraviolet light can be pulsed to create a stroboscopic effect, which is claimed to be an aid to aiming the balls.

The above referenced patents indicate the need for aiming systems with billiards and other games. A need still exists for providing an exact location to aim a cue ball at in order to propel an object ball in an arbitrary desired trajectory.

SUMMARY OF THE INVENTION

The present invention provides a system for aiming billiards balls and like projectiles that utilizes an array of small colored dots uniformly blanketing the surface of the object balls. The dots are of a size and color to render them visible at distances common to the game of billiards, and are disposed so that adjacent dots are dissimilarly colored, in order to more easily distinguish between the dots. A uniform background or border color between dots may be provided to facilitate distinguishing the dots. The dots may be visible only when illuminated with electromagnetic radiation having wavelengths outside the spectra of visible light, so that the dots may be selectively illuminated for training or other purposes.

To aim a cue ball at an object ball in order that the object ball travel in a desired trajectory, a dot on the object ball is first located which is in line with the desired object ball trajectory and on an opposite side of the object ball from the desired trajectory. Since pool is played on a flat, horizontal surface, this dot will lie in a band encircling the object ball halfway between the top and the bottom of the ball, and represents the point of contact between the cue ball and the object ball which will send the latter in the desired trajectory. Next, the cue ball must be aimed so that it contacts the object ball at the desired dot. This is done by aiming for an imaginary spot that is separated from the contact dot by a distance equal to the radius of the object ball and in a direction in line with but opposite to the desired trajectory.

The varied colors of the dots allow a player to distinguish and remember the contact dot in order to easily aim correctly, without the benefit of guesswork or experience. The system also trains players in an accurate method of aiming that can be utilized without the colored dots.

DISCLOSURE OF THE INVENTION

Figure 1:
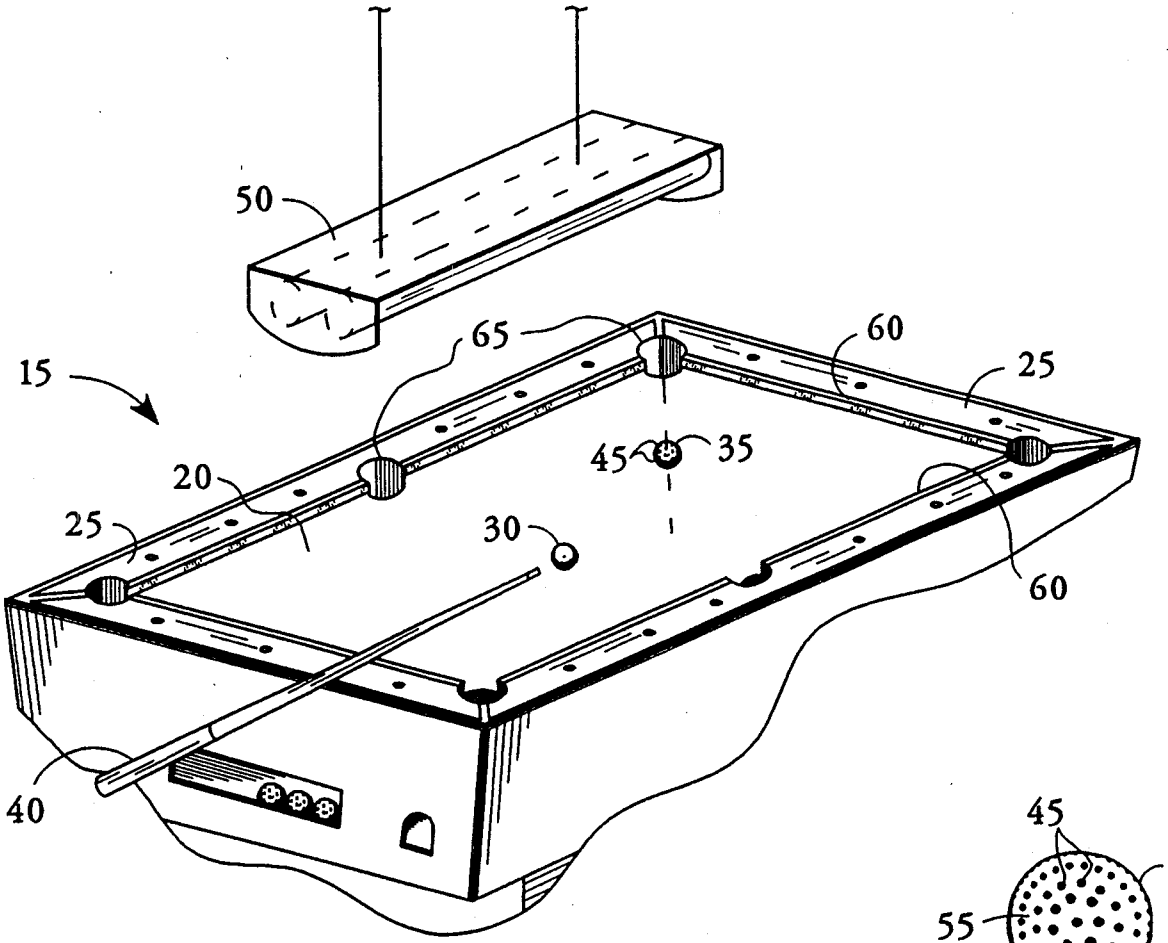
FIG. 1 is a perspective view of a billiard table, balls and lamp of the present invention.

In FIG. 1, a billiard or pool table 15 having a level playing surface 20 is bordered by a generally rectangular railing 25. A pool or billiard cue ball 30 and object ball 35 are shown lying on the surface 20, with a cue stick 40 positioned nearby. The object ball 35 has an array of small colored dots 45 uniformly distributed on its surface. A lamp 50 hangs overhead which includes a source of invisible electromagnetic radiation that causes the dots 45 to emit visible light in reaction thereto. The lamp 50 can be controlled to emit only visible light, only invisible electromagnetic radiation, or both visible light and invisible electromagnetic radiation. Pockets 65 that commonly serve as targets are disposed within the railings 25 at an edge of the playing surface 20.

Figure 2:
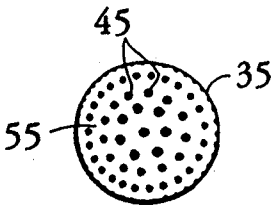
FIG. 2 is a view of an object ball of the present invention.

FIG. 2 shows an object ball 35 with a multitude of dots 45 covering its surface. Although it is difficult to illustrate in the black and white drawing of FIG. 2, the dots 45 are colored and arranged so that adjacent dots 45 are of different colors. In a preferred embodiment, the ball 35 has a black background 55 between a multicolored array of dots 45. The embodiment is designed to facilitate distinguishing a dot 45 from surrounding dots 45.

Figure 3:
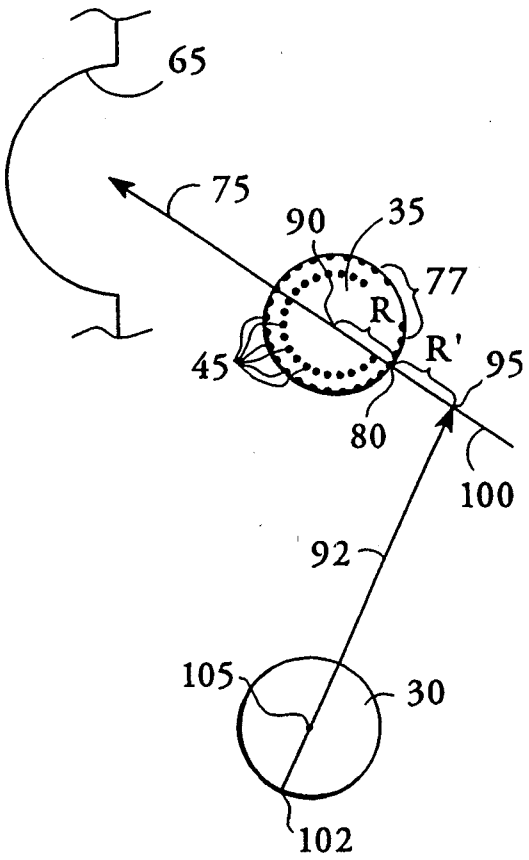
FIG. 3 is a top view of a cue ball being aimed at an object ball of the present invention to propel the object ball in a desired trajectory.

Referring now to FIG. 3, a cue ball 30 and an object ball 35 are spaced apart an arbitrary distance and it is desired that the object ball 35 be directed by impact from the cue ball an arbitrary direction, such as toward a pocket 65, indicated by arrow 75. The object ball 35 has been coated with an array of colored dots 45 which, for ease of illustration, are shown primarily near an equator 77 separating a top and a bottom hemisphere of ball 35. To aim the object ball 35 in the desired trajectory 75, a contact dot 80 is selected which is located on the object ball 35 furthest from the desired target and in line with that trajectory 75. This contact dot 80 can be seen to be on the equator 77 that divides a top and bottom half of the ball 35. To locate the contact dot 80, a player will typically sight from behind the object ball 35 toward a target, such as a pocket 65, that he or she would like the object ball 35 to travel to. Then, remembering the position and color of the contact dot 80, the next step is to shoot the cue ball 30 to hit the object ball at the contact dot 80. To do this, the player locates a center 90 of the object ball 35. The center 90 is, of course, hidden from view inside the object ball 35, but can be easily envisioned.

The cue ball 30 is then aimed in a direction shown by arrow 92 at an imaginary spot 95 that is located on a line 100 extending through the center 90 and the contact dot 80 of the object ball 35, the spot 95 located a distance R′ from the contact dot 80 equal to the distance R between the center 90 and the contact dot 80. In other words, the spot 95 to aim for is spaced from the contact dot 80 by a distance equal to the radius R of the object ball 35 in a direction opposite the desired post-collision trajectory 75. To propel the cue ball 30 toward the aim spot 95, the cue ball is struck by a cue stick (not shown) at a point 102 on its surface collinear with arrow 92, and in a direction from point 102 towards a center 105 If a spin, termed "English", is desired to be imparted to the cue ball 30, the cue stick should strike the cue ball 30 slightly away from point 102 and in a somewhat different direction.

Figure 4:
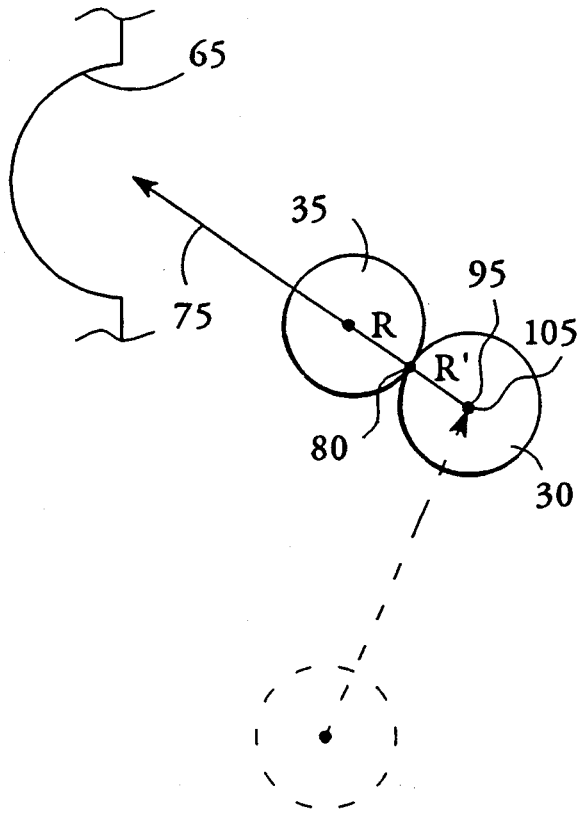
FIG. 4 is a top view of the balls of FIG. 3 at the moment of impact.

Referring to FIG. 4, the cue ball 30 is seen at the instant of impact with the object ball 35 after having been propelled to the aim spot 95. Since the cue ball 30 has a radius R′ that is of approximately equal length to the radius R of the object ball 35, when the center 105 of the cue ball 30 has reached aim spot 95, it is separated from the object ball 35 by radius R′, and thus contacts the object ball 35 at contact dot 80. To a good approximation, the cue ball 30 and the object ball 35 can be considered spheres which undergo a perfectly elastic collision, meeting only at contact dot 80, in which case the transfer of energy from the center of mass of the cue ball 30 to that of the object ball 35 through the contact dot 80 will propel object ball 35 along desired trajectory 75.

Figure 5:
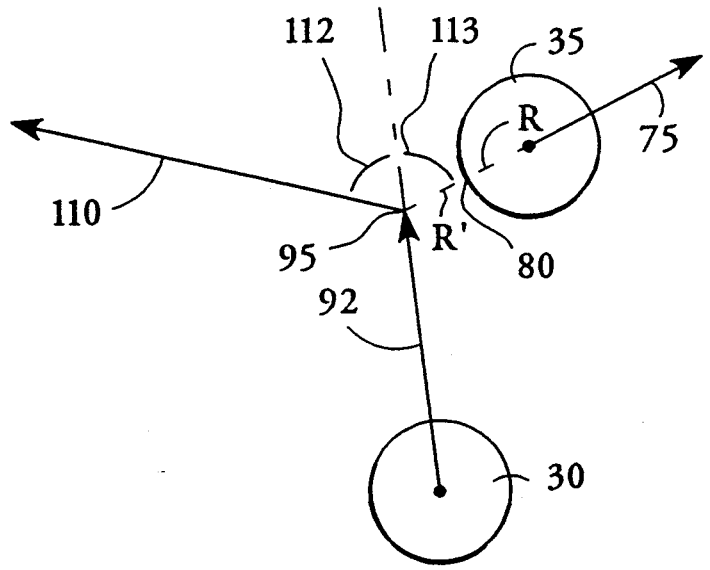
FIG. 5 is a top view of a cue ball aimed at an object ball to produce known object ball and cue ball trajectories.

Referring to FIG. 5, a cue ball 30 and a object ball 35 are shown arbitrarily spaced from each other. In this illustration, object ball 35 is desired to be propelled to the right along trajectory 75. As before, contact dot 80 is sighted and then aim spot 95 is found one radius R′ from contact dot 80 in a direction opposite to trajectory 75. Driving the cue ball 30 along trajectory 92 toward aim spot 95 causes the cue ball 30 to strike the object ball 35 at contact dot 80, propelling object ball 35 along a desired trajectory 75.

Assuming that the cue ball 30 and the object ball 35 are of equal mass and neglecting, as above, any spin of the cue ball 30, the cue ball 30 will travel along a post collision trajectory 110 having an angle 112 from trajectory 92 that is equal and opposite to an angle 113 between trajectory 92 and trajectory 75. Thus, the post collision trajectory 110 of the cue ball 30, another important aspect of the game of billiards, can also be accurately determined via the present invention.

With the help of the aiming system described above, other techniques such as applying a spin to the cue ball 30 can be more easily employed. While billiard balls provide a convenient illustration of the present invention, this aiming system can more generally be employed for any rigid body that undergoes an elastic collision with another rigid body having a convex surface with visible contact dots.

The dots 45 must be large enough to be seen but small enough to be useful in aiming. It is known that normal human eyesight can resolve dots that subtend as little as one minute of arc. For example, a person with such normal visual acuity should be able to see a dot 45 that is one hundredth of an inch in diameter at a distance of three feet. On the other hand, a lateral error of as little as one inch over a distance traveled by a object ball 35 of several feet may be required for accuracy in the game of billiards. Thus the angular error introduced by the diameter of the dot 45 which subtends the radius R of the object ball 35 must be no more than the allowed angular error of one inch over several feet. An allowed error of one inch over three feet is an angular error of one part in thirty-six, or about two degrees. Since the object balls have a radius R of somewhat over one inch, a dot resolvable with normal eyesight having a diameter of one hundredth of an inch introduces an error of one part in one hundred, or less than one degree, which is within the accuracy required for billiards. In fact, for many shots, a lateral error of one inch in six inches of travel may be acceptable, which could be obtained with dots of a diameter as large as one sixth of an inch.

Thus the dots 45 that are uniformly arrayed on the surface of object ball 35 may be of a diameter as small as one hundredth of an inch or as large as one sixth of an inch. To allow the invention to be used by people with less than perfect visual acuity or in conditions of poor illumination, the dots should be at least one sixteenth of an inch in diameter. Within that range of diameters, a ball 35 coated with approximately one thousand such dots 45 appears to work well. These dots 45 are generally circular and tangent to each other, having both a diameter and a center to center spacing of approximately one tenth of an inch.

Use of object balls 35 having dots 45 as described in the present invention can train billiard players in an accurate aiming method to be used on balls unadorned with dots. In addition, hand-eye coordination is improved by use of the present invention, as it allows players to concentrate on striking the ball correctly by providing the correct location for aiming the ball.

I claim:

1. A method of aiming a billiard cue ball to collide with an object ball for object ball motion in a desired trajectory comprising:

providing an object ball having a surface blanketed with a plurality of optically contrasting colored dots, locating a single colored contact dot on said object ball which is disposed collinear to a desired trajectory leading to a target for said object ball and which is furthest from said target, and aiming a pool cue ball to contact said object ball at said contact dot, including sighting along a line of travel of a center of said cue ball.

2. The method of claim 1 wherein aiming said cue ball to contact said object ball at said contact dot includes:

determining an imaginary spot collinear with said desired trajectory in a direction away from said target and spaced a distance from said contact dot equal to a radius of said object ball, and aiming said center of said cue ball at said imaginary spot.

3. The method of claim 1 further comprising causing said dots to emit said colors by illuminating said dots with electromagnetic radiation outside the visible frequency spectra.

4. An aiming device for billiards and like games comprising a ball having a surface covered with spaced apart visible dots having a diameter of between one-sixteenth and one-sixth of an inch.

5. The device of claim 4 wherein adjacent said dots have contrasting colors.

6. The device of claim 4 wherein said dots are illuminated with radiation outside the visible spectrum.

7. The device of claim 4 wherein said dots are spaced generally uniformly on said surface.

* * * * *